United States Patent [19]

Sekerich

[11] 4,077,677

[45] Mar. 7, 1978

[54] DRAWER SLIDE ASSEMBLY

[75] Inventor: Michael Sekerich, Spring Valley, N.Y.

[73] Assignee: Buildex, Inc., West Nyack, N.Y.

[21] Appl. No.: 690,223

[22] Filed: May 26, 1976

[51] Int. Cl.[2] ..... F16C 17/00; F16C 29/02

[52] U.S. Cl. ..... 308/3.6; 312/341 R

[58] Field of Search ..... 308/3.6; 312/330 R, 312/341 R

[56] References Cited

U.S. PATENT DOCUMENTS

| | | | |
|---|---|---|---|
| 3,519,315 | 7/1970 | Campbell | 308/3.6 |
| 3,911,835 | 10/1975 | Schill | 308/3.6 |
| 3,973,814 | 8/1976 | Entrikin | 308/3.6 |

*Primary Examiner*—Richard A. Bertsch
*Attorney, Agent, or Firm*—Howard C. Miskin

[57] ABSTRACT

A drawer slide assembly includes a channel shaped track member having formed in the side webs proximate one end of the track member a pair of longitudinal slots adjacent to the track member cross web. A mounting plate has a forwardly offset inner section projecting through a slot and superimposed on the cross web a rearwardly offset outer section coplanar with the cross web. The mounting plate is secured to the cross web by grommets integrally formed with the mounting plate inner section. A ball bearing roller is mounted on the outer section front face and a latch member is pivoted to the outer section outer border. In fabrication the roller and latch member are first assembled on the mounting plate which is then secured to the cross web. Two pairs of interfitting drawer slides are cooperatively associated with a slidable drawer and side supports.

6 Claims, 4 Drawing Figures

DRAWER SLIDE ASSEMBLY

BACKGROUND OF THE INVENTION

The present invention relates generally to improvements in drawer slide mechanism and it relates more particularly to an improved drawer slide track and roller assembly.

It is a common expedient in cabinet and furniture structures to mount the drawers or other sliding components by means of mating cooperating slide and roller assemblies. These slide and roller assemblies conventionally consist of a pair of longitudinal track members mounted on each side of the drawer and opposing side support and rollers slidably engaging respective track members and mounted on the opposite track members. It is a common practice to integrally form each track member, which is generally channel shaped, at one end thereof with a transversely extending mounting plate on which is mounted a roller and latch member, the roller carried by each track member slidably engaging the cooperating transversely offset track member. The track members and rollers are pre-assembled and each assembly is screwed to a respective drawer side wall or to a side support wall. While this construction operates in a highly satisfactory manner and has many advantages, it possesses numerous drawbacks. Among these drawbacks is the expense of the mechanism since it does not readily lend itself to automatic or semi-automatic fabrication. A serious problem which is encountered in such fabrication is the assembly and mounting of the roller to the mounting, particularly where the roller is of the ball bearing type which is assembled directly on the mounting plate as described in copending U.S. patent application Ser. No. 555,793, filed Mar. 6, 1975. In addition, the conventional slide member and roller assembly is frequently unreliable and of little versatility and adaptability.

SUMMARY OF THE INVENTION

It is a principal object of the present invention to provide an improved drawer slide mechanism.

Another object of the present invention is to provide an improved drawer slide track and roller assembly.

Still another object of the present invention is to provide an improved drawer slide assembly which is easy and simple to fabricate.

A further object of the present invention is to provide a device of the above nature characterized by its ruggedness, simplicity, low cost and great versatility and adaptability.

The above and other objects of the present invention will become apparent from a reading of the following description taken in conjunction with the accompanying drawing which illustrates a preferred embodiment thereof.

In a sense, the present invention contemplates the provision of a drawer slide assembly comprising a longitudinally extending channel shaped track member including a cross web and side webs extending along the longitudinal edges of the cross web, one of the side webs having a recess proximate an end thereof adjacent to the cross web, a transversely extending mounting plate projecting through the recess and overlying and secured to the front face of the cross web and a roller mounted on the front face of the mounting plate and transversely offset from the track member.

In accordance with the preferred embodiment of the present invention recesses in the form of longitudinal slots are formed on both side webs at the same ends thereof and the mounting plates include an inner forwardly offset section passing through one slot of superimposed on the cross web front face and an outer rearwardly offset section coplanar with the cross web. Tubular shanks are integrally formed with the mounting plate inner section and engage openings in the cross web and have their ends upset to tightly clinch the cross web rear face. The roller is of the ball bearing type and directly assembled to the mounting plate outer section front face to the outer border of which is pivoted a latching lever.

The improved drawer slide assembly is simple, rugged, inexpensive and reliable, is of great versatility and adaptability and is easy and convenient to fabricate and apply.

DESCRIPTION OF THE PREFERRED EMBODIMENT

Figure 2:
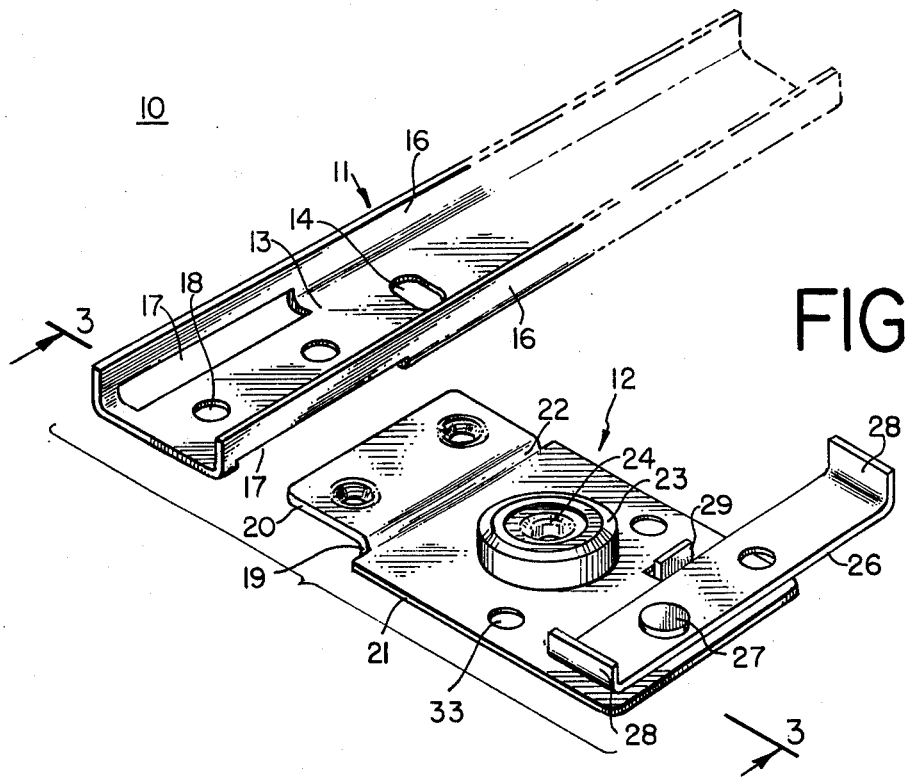
FIG. 2 is a perspective partially exploded view of the drawer slide assembly.
Figure 3:
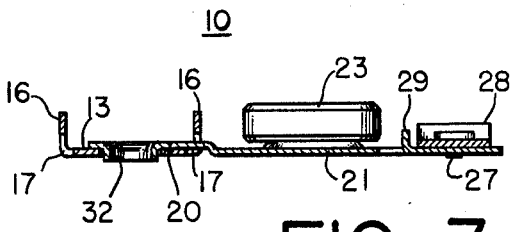
FIG. 3 is an end view taken along line 3—3 in FIG. 2 showing the slide in partially assembled condition.

Referring now to the drawing which illustrates a preferred embodiment of the present invention, the reference numeral 10 generally designates the improved drawer slide assembly which includes a track member 11 and a mount plate roller sub-assembly 12.

The track member 11 is suitably stamped and shaped from sheet metal or otherwise formed in the known manner and is of elongated channel shape including a flat base or cross web 13 having longitudinally spaced medially located mounting openings 14. Integrally formed with the cross web 13 and extending along the full lengths or the opposite longitudinal edges of the cross web 13 are narrow parallel side webs 16 which are perpendicular to the cross web 13. An elongated narrow slot 17 is formed along the junctions of side webs 16 and cross web 13 at one end of track member 11, the slots 17 extending upwardly along corresponding side webs 16 and inwardly from the side edge in cross web 13. A pair of longitudinally spaced coupling bores 18, are formed in cross web 13 medially between the opposite slots 17.

The roller mounting plate pre-assembly 12 comprises a metal mounting plate 19 which includes a rectangular inner section 20 of width approximately equal to the length of a slot 17 and a rectangular outer section 21 of greater length and width than the section 20. The plate section 21 is parallel to and rearwardly offset from the plate section 20 an amount about equal to the thickness of the cross web 13 and is joined along its inner edge to plate section 20 by a shoulder defining wall 22.

A roller 23 is transversely medially mounted on the front face of the outer plate section 21 between the end edges thereof and is rotatable about an axis perpendicular to plate section 21. The roller 23 is formed of a synthetic resin such as nylon or other suitable material and is ball bearing coupled to outer plate section 21 by means of a tubular inner race member 24 coupled to a stepped annular flange surrounding an opening in outer plate section 21 and a group of ball bearings entrapped between the inner race member 24 and the inside annular face of roller 23 which defines an outer race. The roller 23, and the ball bearings and race are directly assembled to outer plate section 21 and is of the structure described in detail in the above identified copending patent application Ser. No. 555,793.

A latch member 26 in the form of a lever is swingably mounted by a pivot 27 to the center of the outer border of the front face of plate outer section 21 and is rockable about a longitudinally offset point between the ends of latch member 26. The latch lever terminates at opposite ends in forwardly directed flanges 28, one end of lever 26 projecting beyond one edge of outer plate section 21 and the other end being disposed within the opposite edge thereof. A stop tab 29 is formed on outer plate section 21 proximate the inner longer edge of lever 26 to restrict its counter-clockwise rotation as viewed in FIG. 2. The structure and function of latch member 26 are, per se, well known and it serves to releasably restrict a pair of mating slide assemblies 10 to their slidable coupled position and prevent their inadvertent separation.

Figure 4:
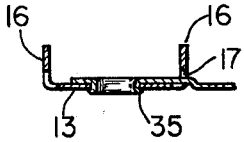
FIG. 4 is a view similar to FIG. 3 showing a part of the slide in locked fully assembled condition.
Figure 1:
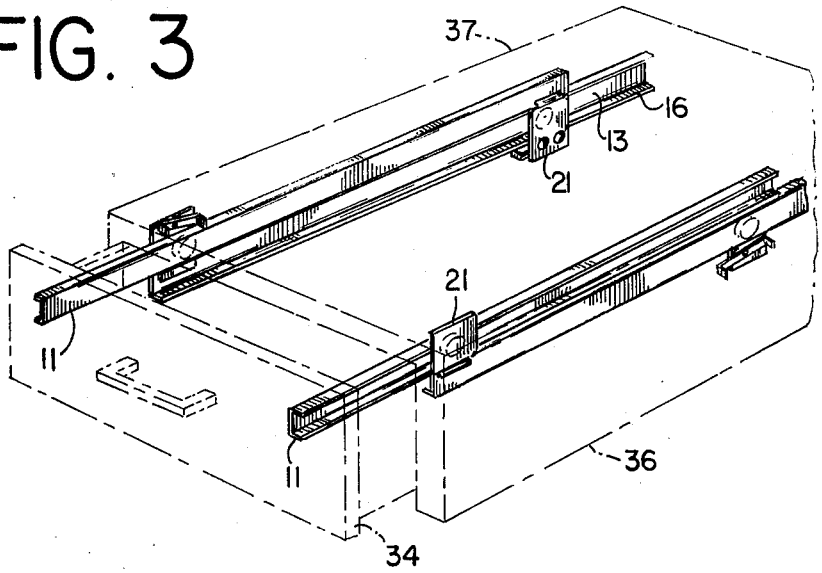
FIG. 1 is a front perspective view of a cabinet with a drawer provided with sets of the improved drawer slide assemblies.

A pair of longitudinally spaced tubular coupling shanks 32 are medially integrally formed from plate inner section 20 and engage respective openings 18, the plate inner section 20 traversing a slot 17 and being superimposed on cross web 13, the outer plate section 21 being coplanar with cross web 13. The outer ends 35 of shanks 32, as seen in FIG. 4, are upset to tightly clinch the underface of cross web 13 and lock track member 11 and sub-assembly 12 into firm assembly. A pair of longitudinally spaced coupling openings 33 are formed between roller 23 and latch lever 26.

In producing the drawer slide assembly 10, the track member 11 is formed and the sub-assembly 12 is separately produced, the roller being fabricated and applied as described in the earlier identified patent application. Thereafter, the sub-assembly 12 and track member 11 are assembled and secured as explained above.

The slide assembly is applied and operates in the known manner. Thus, a pair of similarly oriented slide assemblies 10 are secured to the side walls of drawer 34 by being screwed thereto through openings 14 and 33. A pair of slide assemblies 10 are also similarly screw secured to the inside side walls 36 of a cabinet 37 body or shell and are oriented oppositely to the slide assemblies 10 on the side walls of drawer 34. The drawer 34 is then inserted in the known manner, to bring the rollers 23 of each assembly 10 into sliding engagement with the track members 11 of oppositely vertically offset parallel assemblies 10. The latch members 26 are operated in the known manner.

While there has been described and illustrated a preferred embodiment of the present invention, it is apparent that numerous alterations, omissions and additions may be made without departing from the spirit thereof.

I claim:

1. A drawer slide assembly comprising a longitudinally extending channel shaped track member including a cross web and side webs extending along and projecting forwardly from the longitudinal side edges of said cross web, one of said side webs having a recess formed therein proximate an end thereof and adjacent to and along said cross web, said cross web being substantially continuous from end to end, a transversely extending mounting plate projecting through said recess and overlying and secured to the front face of said cross web and a roller mounted on the front face of said mounting plate and transversely offset from said track member.

2. A drawer slide assembly comprising a longitudinally extending channel shaped track member including a cross web and side webs extending along and projecting forwardly from the longitudinal side edges of said cross web, one of said side webs having a recess formed therein proximate an end thereof and adjacent to and along said cross web, a transversely extending mounting plate projecting through said recess and overlying and secured to the front face of said cross web and a roller mounted on the front face of said mounting plate and transversely offset from said track member, said mounting plate including a forwardly offset inner section projecting through said recess and overlying said cross web and a rearwardly offset outer section coplanar with said cross web.

3. The drawer slide assembly of claim 2 wherein said recess comprises a longitudinally extending slot formed in said side web along the junction of said cross web and said side web.

4. The drawer slide assembly of claim 3 wherein a similar slot is formed in each of said side webs proximate a common end thereof.

5. The drawer slide assembly of claim 2 wherein said cross web has a coupling opening formed therein proximate said recess and comprising a tubular coupling shank integrally formed with said mounting plate inner section and engaging said coupling opening and having its free end outwardly offset into engagement with the rear face of said cross web.

6. The drawer slide assembly of claim 2 including a latch member pivoted to the front face of the outer border of said mounting plate outer section, said roller being disposed between said truck member and said latch member.

* * * * *